United States Patent [19]

Siegenthaler

[11] Patent Number: 4,553,694

[45] Date of Patent: Nov. 19, 1985

[54] COIN COLLECTION BOX FOR AUTOMATIC CASHIERS AND COIN CHANGERS

[75] Inventor: Fritz Siegenthaler, Trub, Switzerland

[73] Assignee: Autelca AG., Gümligen, Switzerland

[21] Appl. No.: 665,558

[22] Filed: Oct. 29, 1984

[30] Foreign Application Priority Data

Nov. 18, 1983 [CH] Switzerland ..... 6206/83

[51] Int. Cl.[4] ..... G07F 1/00

[52] U.S. Cl. ..... 232/7; 232/43.1; 194/1 D; 194/1 F

[58] Field of Search ..... 232/7, 43.1, 55, 57; 194/1 D, 1 F, 1 K, 97 A

[56] References Cited

U.S. PATENT DOCUMENTS

| | | | |
|---|---|---|---|
| 871,824 | 11/1907 | Rule | 194/1 D |
| 2,865,561 | 2/1958 | Rosapepe | 232/7 |
| 3,004,701 | 10/1961 | Antonoff | 232/7 |
| 4,342,384 | 8/1982 | Fukase et al. | 232/1 F X |

FOREIGN PATENT DOCUMENTS

| | | | |
|---|---|---|---|
| 2022897 | 12/1979 | United Kingdom | 194/1 D |

*Primary Examiner*—Robert P. Swiatek
*Attorney, Agent, or Firm*—Brady, O'Boyle & Gates

[57] ABSTRACT

The compartments (3) of a compartment ring (1) rotatable stepwise about its horizontal axis (2) are bounded at the ring end faces by circular-ring walls (6, 7), at the outer ring circumference by a cylindrical annular wall (19) exhibiting at the top an inlet opening (23) leading into respectively one compartment (3*a*), and at the inner ring circumference by a conical annular wall (20) exhibiting at the top an outlet opening (24) offset with respect to the inlet opening (23) in a direction of rotation (17) of the ring, this outlet opening leading into a coin return channel (26) and into a coin overflow channel (27). Upon rotation of the ring in this direction (17), the last-received coins drop into the coin return channel (26). Upon rotation in the opposite direction (18), respectively one coin is received while another coin, exceeding the capacity of the compartment ring (1), drops into the coin overflow channel (27). The conical shape of the inner annular wall (21) prevents that a coin, dropping through the inlet opening (23) into a compartment (3*a*) and rebounding, projects temporarily into the inlet opening (23) where it could block the coin collection box during the immediately subsequent rotation of the compartment ring. Ribs (34) on the compartment walls (4) prevent sticking of a coin to the walls. By means of ribs (35) at the outlet opening (24), the coins are lifted before they reach this opening, and are thereby detached from the compartment walls (4), if necessary.

10 Claims, 2 Drawing Figures

Fig. 1
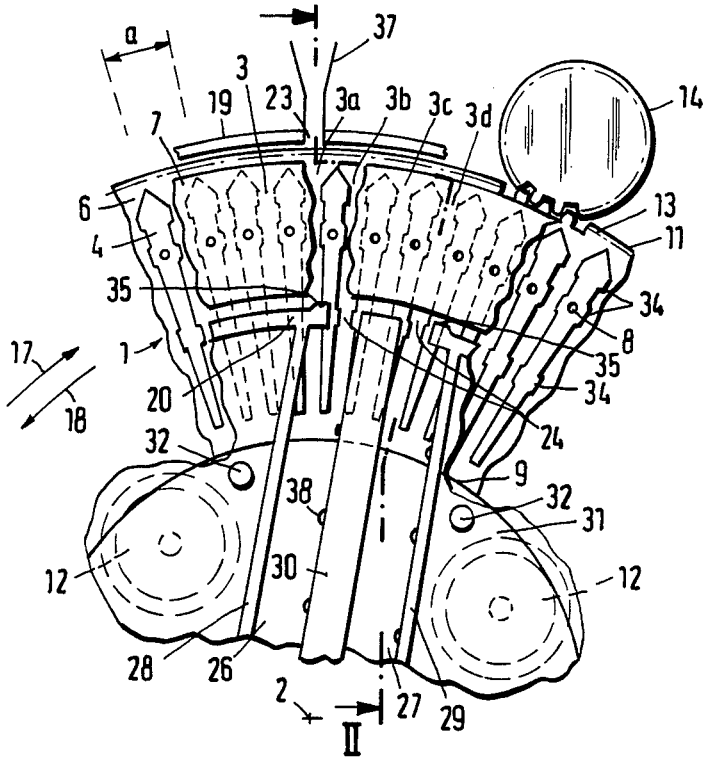
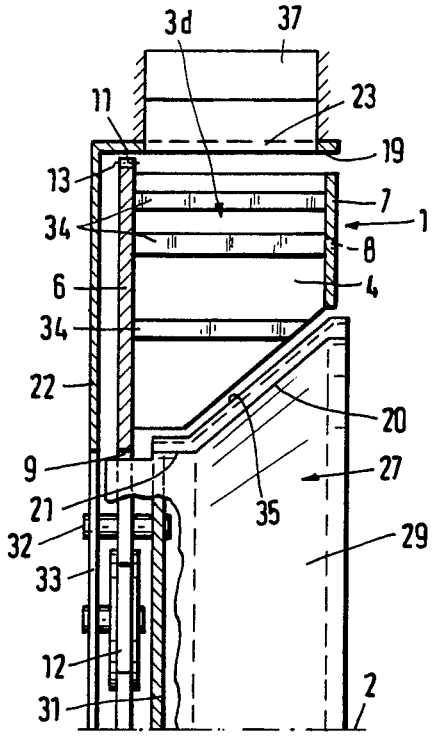
Fig. 2

COIN COLLECTION BOX FOR AUTOMATIC CASHIERS AND COIN CHANGERS

The invention relates to a coin collection box for automatic cashiers and coin changers.

BACKGROUND OF THE INVENTION

Such a coin collection box is to accommodate a sufficient number of coins in a limited space. Unless this coin collection box is to serve merely as an intermediate storage means for one or a few cashiering steps, it must lend itself to being designed with an overflow to remain operable even in the filled condition. And it also is to be suitable for returning coins, for example after actuating a correction key; in this case, the respectively last inserted coins are to be returned so that there is no possibility of fraudulently inserting coin-like items or lower-value coins and then having coins of the correct value issued by actuation of the correction key. Coin collectors of the type set forth in the prior art exhibit these properties, and they are furthermore simple in structure and mode of operation because they require no conveyor means, such as tappets, for example, for the collection and dispensing of coins. The coins simply drop into the compartments and out of them on account of their weight.

In a conventional coin collection box of this type, the ring of compartments is arranged upright, i.e. its axis is disposed horizontally. The first and second fixed ring walls are coaxial cylindrical ring walls, the first thereof exhibiting the insert opening at the top and the second one thereof exhibiting the outlet opening leading into a coin return channel at the top and, beside this channel, into a coin overflow channel. A coin dropping through the inlet opening into a compartment impinges on a practically horizontal wall surface portion of the second cylindrical ring wall (Swiss Pat. No. 600,453). The compartment ring of another coin collection box of this type is arranged in a prone position, i.e. with a vertical axis. The first and second fixed ring walls are coaxial, parallel circular ring walls, the upper one of these exhibiting the insert opening and the lower one of these containing the issuance opening leading into a coin return channel. A coin dropping through the insert opening into a compartment impinges on the horizontal surface of the second fixed circular ring wall (Swiss Pat. No. 635,950).

In these conventional coin collection boxes, a coin dropping through the inlet opening drops on a surface perpendicular to the dropping direction; the coin rebounds from this surface and thereby can pass temporarily back into the inlet opening, which depends on the material of the second, fixed ring wall, the weight and alloy of the coin, as well as the dimensions of the compartment as compared with the coin diameter, and also depends on the incidental contact between the coin and compartment walls. To prevent the rebounding coin from being located, during the subsequent rotation of the ring of compartments, partially in the inlet opening and partially in the compartment into which it has dropped, thus being jammed, and blocking the drive mechanism of the ring of compartments and thus the entire coin collection box, the ring of compartments could only be further rotated by one step after a time period had passed, since feeding of the coin, adequate for the coin to assume a rest position in the respective compartment even under adverse conditions. The risk of rebounding exists especially in case of clean coins which do not tend to adhere to the compartment walls of the compartment and therefore impinge on the second ring wall almost in free fall. In case of dirty coins, or coins wet from rain water or snow, for example, the risk of rebounding is indeed lesser since such coins tend to adhere to the compartment walls. However, also in this case the operation of the coin collection box could be disturbed, especially likewise blocked, for such a coin could adhere in a position where it projected into the inlet or into the outlet openings while the ring of compartments was rotating. A coin could also stick in the compartment. Once the compartment came to be located underneath the inlet opening, the subsequent coin would fall on the stuck coin, blocking the ring of compartments including its rotary drive. If a stuck coin, which should have dropped into the coin overflow channel, was detached too late, it would fall into the coin return channel and would be unduly returned; this fact would not be recorded by a coin counter customarily provided for control, especially accounting purposes so that the number of actually collected coins would not correspond to the counted number. Sticking of coins to the compartments is essentially due to the following causes: during the stepwise rotation of the ring of compartments, the coins, necessarily present with a clearance in the compartments, are jiggled each time, i.e. they are accelerated and decelerated. During such process, the coins could assume positions wherein they are in flat contact with a compartment wall. With an upright ring of compartments, this was even unavoidable because the compartment walls, during rotation of the ring about the horizontal axis, assume horizontal and slightly inclined positions. A coin moist, for example, due to rain or snow, or a dirty coin, which is separated merely by a thin film of water or dirt from a planar, especially almost horizontal surface tends to adhere to such surface, as experience has shown. This leads to the aforementioned disturbances. Once the ring of compartments and its rotary drive mechanism are blocked thereby, or by a rebounded coin, the automatic cashier or coin changer is no longer usable until the trouble has been eliminated by personnel trained in servicing the device. Coin collection boxes of the type discussed hereinabove tend toward such disturbances in particular because the coins are not positively conveyed by conveying means, for example tappets (such as, for instance, in the coin collection box with compartment ring according to Swiss Pat. No. 444,548) but rather drop, in a much simpler way, only on account of their weight into the compartments and out of them. Accordingly, the advantage of the elimination of such conveying means was confronted by the disadvantage of being prone to trouble.

SUMMARY OF THE INVENTION

The invention seeks to overcome this drawback. As characterized in the claims, the invention solves the problem of providing a coin collection box wherein disturbances caused by rebounding of a coin or by sticking of a dirty coin or moist coin are avoided, the means accomplishing this objective being extremely simple and correspondingly inexpensive.

The advantages attained by the invention are to be seen essentially in that the compartment ring, after receiving a coin, can be immediately rotated further by one step, and that even when a coin is transferred to the coin return channel or the coin overflow channel, the coin will with certainty drop immediately into this channel, so that the coin return is ensured and also disturbances due to an overcrowded ring of compartments caused by lack of overflow function, as well as undesired coin returns, are avoided. In particular, trouble caused by blockage of the ring of compartments and of its rotary drive mechanism is eliminated, which trouble would prevent continued usage of the automatic cashier or coin changer, and which would necessitate the action of trained servicing personnel for its elimination. Additionally advantageous further developments and embodiments of the invention are set forth in greater detail in the specification hereinafter following.

BRIEF DESCRIPTION OF THE DRAWINGS

The invention will be described in greater detail below with reference to drawings showing merely one embodiment of the invention, using as the example a coin collection box with an upright compartment ring.

In the drawings:

FIG. 1 shows a partial frontal view of a coin collection box and

FIG. 2 shows a section along line II—II in FIG. 1.

DESCRIPTION OF THE PREFERRED EMBODIMENTS

The figures illustrate a coin collection box for automatic cashiers and coin changers comprising, as the essential component, a compartment ring 1, the compartments 3 of which, extending radially to the ring axis 2, are formed respectively between two compartment walls 4 axially projecting from a circular ring wall 6. The compartment walls 4 are fashioned integrally with the circular ring wall 6 and are mounted oppositely thereto on a circular ring wall 7 coaxial to the first-mentioned ring wall; only two fragments of this ring wall 7 are shown in FIG. 1. For this purpose, peg-shaped extensions 8 of the compartment walls 4 are arranged in holes of the circular ring wall 7, and at least a number of these extensions 8, formed integrally with the compartment walls 4, is fixedly welded within the holes of the circular ring wall 7; for this purpose, the circular ring wall 6 with the compartment walls 4 and pegs 8, as well as the circular ring wall 7 are made of a synthetic resin or synthetic resins suitable for this purpose. The inner rim 9 and the outer rim 11 of the circular ring wall 6 extend past the compartment walls 4. On the inner rim 9, the ring of compartments 1 is supported to be rotatable about its axis 2 by means of four grooved profile rollers 12 (only two of which are illustrated). The outer rim 11 is equipped with an external serration 13 meshing with a gear wheel 14; the latter is driven by a switching mechanism, for example a Geneva motion gear, not shown, whereby the ring of compartments 1 can be rotated stepwise in opposite directions 17 and 18, each step corresponding to a compartment division a. As can be seen, the compartments 3 are defined along the end faces of the ring by the circular ring walls 6 and 7. On the external ring circumference, the compartments 3 are defined by a first fixed ring wall 19 which is cylindrical. Along the inner ring circumference, the compartments 3 are delimited by a second fixed annular wall 20 of an essentially conical configuration, i.e. forming a conical-area surface and having a cylindrical extension 21 (FIG. 2). The inner edges of the compartment walls 4 with respect to the compartment ring 1 extend in correspondence with this wall 20, 21.

The first fixed, cylindrical outer annular wall 19 is joined to the housing wall 22 and exhibits at the top a slot-like inlet opening 23 adapted to the width of the compartment; this opening, in each position of the compartment ring 1 corresponding to a stop position of the switching mechanism leads respectively into one of the compartments 3, in the drawing into compartment 3*a*.

The second fixed, essentially conical inner annular wall 21, 22 has a likewise slot-like, but wider outlet opening 24, the slot width of which extends in each stop position of the compartment ring 1 over the three compartments 3*b*, 3*c*, and 3*d* succeeding compartment 3*a* in direction 17. In this arrangement, the outlet opening 24 leads, from compartment 3*b*, into a coin return channel 26 and, from compartment 3*d*, into a coin overflow channel 27. These channels 26 and 27 are bounded by two walls 28 and 29 and separated from each other by a partition 30. The cylindrical extension 21 of the ring wall 20, 21 has a cylindrical bottom 31 provided with a cutout for channels 26 and 27; this bottom is joined to the housing wall 22 by means of pins 32 (FIG. 2). The housing wall 22 has an aperture 33 coaxial to the compartment ring 1. The coin channels 26 and 27 can be extended out of the space enclosed by the inner ring wall 20, 21 either, as shown in FIG. 2, toward the right or through the aperture 33 toward the left. Also the corresponding channels of neighboring compartment rings can extend through this space.

The compartment walls 4 are provided with ribs 34 that project, for example, by 0.2–0.3 mm. The ribs 34 prevent flat contact of a coin against a compartment wall 4, which would lead to adhesion and trouble if the coin is wet or dirty or if the compartment wall has been wetted or dirtied by a previously accommodated wet or dirty coin. The ribs 34 extend in spacings smaller than the coin diameter from a compartment wall rim toward the opposite rim in directions in parallel to the axis 2 of the compartment ring. The latter feature makes it possible to manufacture the compartment ring 1 integrally with the compartment walls 4 and the ribs 34 formed thereat, which cannot be done in case of ribs that extend in a different way or are interrupted, or in case of other protuberances, such as humps. Respectively one rib 35 is formed along the two radially outward rims of the outlet opening 24 of the inner ring wall 20, 21, which rims extend along a conical shell line and along a cylindrical shell line. These ribs lift up a coin which has been pushed toward the outlet opening 24 during a rotational step (a) of the compartment ring 1 and thereby detach the coin from the compartment wall 4, if necessary, immediately before the coin passes over the outlet opening 24. If only one of these two channels 26, 27 is present, then one of these ribs 35 is omitted. The ribs 34 are beveled to prevent a coin, when it drops into a compartment 3, from catching on one of the ribs 34 or, when it is lifted by one of the ribs 35, from abutting against a rib 34. The ribs 35 are beveled along the side facing away from the outlet opening 24.

It is also possible to arrange ribs 38 (FIG. 1) or other protuberances for precautionary purposes on the walls of a coin feed channel 37, of the coin return channel 26, and or the coin overflow channel 27. However, sticking of coins to these walls represents a lesser risk since the coins drop through these channels either in free fall or along a rather steep, inclined plane.

The end face of a smaller diameter of the essentially conical ring wall 20, 21 faces the circular ring wall 6, formed integrally with the compartment walls 4, of the compartment ring 1. Since in this arrangement the conical surface lines of the ring wall 20 extend at an acute angle with respect to the circular ring wall 6, the objective is attained that the compartment walls 4 are formed at the circular ring wall 6 with the longer one of their two marginal sides that extend radially with respect to the compartment ring 1. This is advantageous for the ruggedness of the compartment ring 1 and makes it possible to design the radially inward ends of the compartment walls 4 to be relatively thin, i.e. to accommodate a large number of compartments with any given ring dimensions.

The coins are collected by means of the illustrated coin collection box by rotating the compartment ring 1 each time by one step (compartment division a) in the direction of arrow 18 after a coin has dropped through the coin feed channel 37 into the compartment 3 into which this channel 37 leads; in case of FIG. 1, this is the compartment *3a*. After this rotation, the inlet channel leads into the compartment following in the direction of arrow 17; in FIG. 1 this is the compartment *3b*. This compartment is empty in any event, for it has passed the outlet opening 24, during which step—if a coin was contained in the compartment—this coin has dropped into the coin overflow channel 27. If, after the collection of one or several coins, a correction key (not shown) is depressed, then the compartment ring 1 will be rotated, for each last-inserted coin, by one step in the direction of arrow 17, this coin or these coins dropping into the coin return channel 26.

A coin dropping from the coin feed channel 37 into a compartment, for example compartment *3a*, impinges on a conical shell line, inclined with respect to the dropping direction, of the substantially conical inner ring wall 20, and if the coin rebounds, it hits the vertical circular ring wall 6. With this dual impingement, the coin has lost so much kinetic energy that it can no longer project, by additional rebounding motions, temporarily into the inlet opening 23 where it then could block the subsequent rotation of the compartment ring 1. In this connection, it should be considered that the coin, upon rebounding, in most cases does not move freely within the compartment but rather glances off one or both compartment walls 4, thereby losing energy as well.

On the compartment walls 4, the ribs 34 have the effect that the coins can contact the walls 4 only along relatively rather small areas; in this connection, the adhesive strength of a water film in case of wet coins or of a dirt layer in case of dirty coins is not sufficient to keep such coins in the channel or compartment whereby the mode of operation of the coin collection box would be disturbed. Furthermore, the ribs 35 on the rims of the outlet opening 24 cause a coin, before it can pass into the outlet opening 24, to be somewhat lifted and thereby to be detached in case it sticks to one of the compartment walls 4.

In the illustrated embodiment, the storage capacity is equal to the number of compartments minus three; this capacity could be additionally raised by one, in which case the outlet opening 24 would have to extend, instead of across three (*3b, 3c, 3d*) compartments, across two compartments (*3b* and *3c*), and the partition 30 would have to be made correspondingly thinner.

The circular ring wall 6 can exhibit a toothed rim for a drive gear wheel also on the inner rim, instead of on the outer rim, and can be rotatably supported by means of grooved profile rollers on the outer rim, or by means of some other devices.

It is basically possible for the inlet opening to be arranged, instead of at the highest point of the outer cylindrical ring, also at the lowest point of an inner cylindrical ring, and for the outlet opening to be correspondingly located at the lowest point of an external, conical ring.

Furthermore, the coin collection box can be designed also with a horizontal ring of compartments, instead of with a vertical ring as described above. For this purpose, the compartments are to be formed integrally with a cylindrical ring so that they radially project from the latter, and are to be joined at their projecting ends to a second cylindrical ring, or are to be constructed of one piece with both cylindrical rings. The inlet opening, in this arrangement, is to be arranged at an upper circular ring wall, and the compartments are to be delimited at the bottom by a conical annual wall equipped with the outlet opening.

I claim:

1. Coin collection box for automatic cashiers and coin changers, with a compartment ring (1) comprising compartments (3, 3a–3d) formed between compartment walls (4) radially to the ring axis (2) and accommodating respectively one coin, this compartment ring being rotatable about the ring axis (2) in steps corresponding respectively to a compartment division (a) by means of a rotary drive mechanism (13, 14) in opposite directions (17, 18), and the compartments (3, 3a–3d) of this ring being bounded along their periphery by annular walls (6, 7, 19, 20) coaxial to the compartment ring (1), of which a first, fixed annular wall (19) has an inlet opening (23) leading from above into respectively one (3a) of the compartments (3), and a second, fixed annular wall (20, 21) has an outlet opening (24) extending at the bottom from one or several compartments (3b, 3d) offset with respect to this compartment (3a) in a ring rotation direction (17), characterized in that the wall (20, 21) of the annular walls on which drops a coin falling through the inlet opening (23) is inclined at least partially with respect to the inlet direction in such a way that this coin will not rebound into the inlet opening (23); and that the compartment walls (4) exhibit protuberances (34) limiting their contact with a coin to such a small area that the coin cannot stick to the compartment walls (4); and that at least one of the rims of the outlet opening (24) extending transversely to the direction of rotation (17, 18) of the compartment ring exhibits a rib (35) which latter lifts the coins during rotation (17, 18) of the compartment ring (1) prior to reaching the outlet opening (24).

2. Coin collection box according to claim 1, characterized in that the second, fixed annular wall (20, 21) has substantially the shape of a conical zone.

3. Coin collection box according to claim 2 wherein the compartment walls (4) of the compartment rim (1) rotatable about a horizontal axis (2) are formed integrally with a first, circular-ring-shaped ring end wall (6) whereat they project axially and are delimited at the opposite ring end face by a second, circular-ring-shaped ring end wall (7), at the outer or inner ring circumference by the first, fixed cylindrical annular wall (19), and on the inner or outer ring circumference, respectively, by the second, fixed annular wall (20, 21), characterized in that the conical shell lines of the second, fixed annular wall (20), having essentially the shape of a conical zone, form an acute angle with the first ring end wall (6).

4. Coin collection box according to claim 2 wherein the compartment walls of the compartment ring rotatable about a vertical axis are formed integrally with a first, cylindrical annular wall at which they project radially, and are delimited oppositely to this annular wall by a second, cylindrical annular wall, at the top by the first, fixed circular-ring-shaped wall, and at the bottom by the second, fixed annular wall, characterized in that the conical shell lines of the second, fixed annular wall, which latter has essentially the shape of a conical zone, form an acute angle with the surface lines of the first cylindrical annular wall.

5. Coin collection box according to claim 1 or 2 wherein the outlet opening (24) leads into a coin return channel (26) and into a coin overflow channel (27), these channels following each other in the aforementioned ring rotation direction (17), characterized in that both rims of the outlet opening (24) extending transversely to the direction of rotation (17, 18) of the compartment ring exhibit respectively one rib (35).

6. Coin collection box according to claim 5, characterized in that the walls of coin channels (37, 26, 27) leading into the inlet opening (23) and out of the outlet opening (24) exhibit protuberances (38) which restrict contact with the coins to an area insufficient for frictional adhesion.

7. Coin collection box according to claim 1 or 4, characterized in that the compartment walls (4) are of such a wedge shape that the mutually opposed areas of compartment walls (4), respectively forming a compartment (3), are in parallel.

8. Coin collection box according to claim 1, characterized in that the projections (34) of the compartment walls (4), which walls project from an annular wall (6) and preferably are formed integrally with the latter (6), are ribs (34) formed at these walls (4) and extending in parallel to the compartment ring axis (2), these ribs running between mutually opposed compartment wall rims, the mutual spacing of these ribs being smaller than the coin diameter.

9. Coin collection box according to claim 8, characterized in that the compartment walls (4) are joined to the annular wall (7) by pegs (8) preferably formed integrally with these walls (4), which annular wall (7) is located oppositely to the annular wall (6) formed integrally with the compartment walls (4).

10. Coin collection box according to claim 9, characterized in that at least a number of the pegs (8), formed integrally with the compartment walls (4) and made of a synthetic resin, is welded into associated holes of the annular wall (7) consisting of a synthetic resin, which wall (7) is located in opposition to the annular wall (6) formed integrally with the compartment walls (4).

* * * * *